US010603599B2

(12) United States Patent
Cheung

(10) Patent No.: US 10,603,599 B2
(45) Date of Patent: Mar. 31, 2020

(54) TOY TRACK SYSTEM AND TRACK VEHICLE MOVING THEREIN

(71) Applicant: Ever Victory Technology Limited, Hong Kong (CN)

(72) Inventor: Kwong Ming Cheung, Hong Kong (CN)

(73) Assignee: Ever Victory Technology Limited, Kwun Tong, Kowloon (CN)

( * ) Notice: Subject to any disclaimer, the term of this patent is extended or adjusted under 35 U.S.C. 154(b) by 4 days.

(21) Appl. No.: 15/958,211

(22) Filed: Apr. 20, 2018

(65) Prior Publication Data

US 2019/0201801 A1 Jul. 4, 2019

(30) Foreign Application Priority Data

Dec. 28, 2017 (HK) ..... 17113930
Apr. 4, 2018 (CN) ..... 2018 1 0301614

(51) Int. Cl.
*A63H 18/02* (2006.01)
*A63H 21/02* (2006.01)
(Continued)

(52) U.S. Cl.
CPC ..... *A63H 18/028* (2013.01); *A63H 18/02* (2013.01); *A63H 18/08* (2013.01); *A63H 21/02* (2013.01);
(Continued)

(58) Field of Classification Search
CPC ..... A63H 17/00; A63H 17/004; A63H 18/00; A63H 18/02; A63H 18/028; A63H 21/02
See application file for complete search history.

(56) References Cited

U.S. PATENT DOCUMENTS 2,575,055 A * 11/1951 Jaeger ..... A63H 18/021 104/245
3,343,793 A * 9/1967 Waser ..... A63F 7/3622 238/10 R
(Continued)

FOREIGN PATENT DOCUMENTS

CN 201179344 Y 1/2009
WO WO 2017/184836 A1 10/2017

OTHER PUBLICATIONS

SIPO Republic of China Search Report for Hong Kong Short-Term Patent Application No. HK17113930.7, dated Apr. 3, 2018.

*Primary Examiner* — Eugene L Kim
*Assistant Examiner* — Alyssa M Hylinski
(74) *Attorney, Agent, or Firm* — Leydig, Voit & Mayer, Ltd.

(57) ABSTRACT

A toy track system for a track vehicle moving within the system includes a track section having pipe track section that are tightly connected to allow the track vehicle to pass through, and a non-track section formed by arrangement other than the track section. The track section includes an outlet end for the track vehicle to temporarily exit the track section and enter into the non-track section, and an inlet end for the track vehicle to return to the track section from the non-track section. A guiding device is provided at the inlet end for guiding the track vehicle to enter a pipe opening of the inlet end from the non-track section. The guiding device includes an end opening that is wider than the pipe opening. The track section further includes connecting devices having two connecting ports for detachably connecting the pipe track sections.

24 Claims, 12 Drawing Sheets

(51) Int. Cl.
*A63H 18/08* (2006.01)
*A63H 29/22* (2006.01)
*A63H 18/16* (2006.01)

(52) U.S. Cl.
CPC ..... *A63H 29/22* (2013.01); *A63H 2018/165* (2013.01)

(56) References Cited

U.S. PATENT DOCUMENTS 3,621,602 A * 11/1971 Barcus ..... A63H 18/028 446/491
4,250,657 A 2/1981 Barlow et al.
4,585,166 A * 4/1986 Stephens ..... A63H 18/02 238/10 F
5,312,285 A * 5/1994 Rieber ..... A63F 7/3622 273/109
D641,807 S * 7/2011 Hornsby ..... D21/564
8,192,246 B2 * 6/2012 Ostendorff ..... A63H 18/028 446/429
8,944,881 B2 * 2/2015 Payne ..... A63H 18/10 446/444
9,731,212 B2 * 8/2017 Cheung ..... A63H 18/02
10,456,697 B2 * 10/2019 Tai ..... A63H 18/02
2010/0285719 A1 * 11/2010 Laurienzo ..... A63H 17/26 446/444
2010/0330874 A1 * 12/2010 Carlson ..... A63H 18/00 446/446
2012/0220183 A1 * 8/2012 Payne ..... A63H 18/00 446/14
2014/0011425 A1 * 1/2014 Christopherson .... A63H 33/006 446/227
2015/0122903 A1 * 5/2015 Boyce ..... A63H 18/028 238/10 A
2018/0043273 A1 * 2/2018 Farrell ..... A63H 17/004
2018/0104608 A1 * 4/2018 Cherednichenko .. A63H 18/023

* cited by examiner

TOY TRACK SYSTEM AND TRACK VEHICLE MOVING THEREIN

The present application relates to a toy track system and a track vehicle moving therein. Specifically, the present application relates to a toy track system that allows a track vehicle to temporarily leave a track section and return to the track section and a track vehicle that is suitable for operating therein.

BACKGROUND OF THE INVENTION

Toy track systems are typically configured in form of open or uncovered tracks, so that a player may feel the sense of speed by directly watching the track vehicles moving therein. However, according to the above toy track system, a track vehicle moving therein may fall out of the track when passing certain positions at a high speed, particularly at curved or slanted track portions. The track vehicle falling out at a high speed may be easily damaged or even poses a danger to players or bystanders.

Although a toy track system in form of connected pipes may be able to substantially address the above issue, such track system in the form of pipes substantially encloses the track vehicle moving therein. Thus, the player or the bystander cannot directly feel the speed and thereby greatly hindering enjoyment.

A typical track system only allows the track vehicle to run on a preset track at all times, and such track vehicle would usually be operated in a passive manner. For example, typical track vehicle has only a manual power switch, hence the track vehicle only goes forward along the preset track. In addition, a typical track system would only allow the player to assemble and erect the track on a flat surface, such as the floor or a table. These types of track systems have very limited variations and thus cannot satisfy some players or bystanders.

The present invention aims to eliminate or at least alleviate such deficiencies by providing an innovative and improved toy track system and track vehicles.

SUMMARY OF THE INVENTION

The invention provides a toy track system, which can be used for a track vehicle to move therein, including a track section. The track section includes of a plurality of pipe track section tightly connected to each other to allow the track vehicle to pass therethrough, as well as non-track sections. The non-track section includes arrangements other than the track section. The track section has an outlet end for the track vehicle to temporarily leave the track section and enter the non-track section, and an inlet end for the track vehicle to return to the track section from a non-track end. The inlet end is provided with a guiding device for guiding the track vehicle to enter a pipe opening of the inlet end from the non-track section, the port of the guiding device is wider than that of the pipe opening. The track section further includes a plurality of connectors with two connecting ports, which are used for detachably connecting the plurality of pipe track section.

In an embodiment, the track section further includes a half-tube track section or a vertical-loop track section.

Preferably, a guiding shroud with a conical flange is provided between the half-tube track section and the pipe track section. The larger end of the guiding shroud faces the half-tube track section, while the smaller end faces the pipe track section.

In an embodiment, the toy track system includes a double-track section arranged side-by-side.

Preferably, the guiding device may be mounted to the outlet end and the inlet end respectively. The guide device is of a flat fan shape for lying flush against a flat surface. The guiding device further includes a ramp connecting the pipe opening of the outlet end or the inlet end to the flat surface, the transitions between the pipe opening, the ramp and the flat surface being substantially flat.

In an embodiment, the flat surface being part of the non-track section.

In an embodiment, the outlet end is disposed at a distance from the flat surface, the non-track section includes a support base disposed at the lower end of the outlet end, a cable connecting the outlet end and the support base and a sliding device sleeved on the cable and configured to slide along the cable. The inlet end is configured to point vertically upwards and is disposed below the flying cable and between the outlet end and the support base, and the sliding device being configured to convey the track vehicle that moves out from the outlet end to the inlet end.

Further, the sliding device includes a closed-end sleeve, the interior space of the closed-end sleeve being sufficient to accommodate the entire track vehicle. The closed-end sleeve is in sliding fit with a fixed sleeve disposed at the outlet end, and the closed-end sleeve is held stationary on the outlet end by the fixed sleeve.

Preferably, the sliding device is configured such that it is held stationary at the outlet end. When the track vehicle reaches the outlet end, the track vehicle enters the interior space of the closed-end sleeve, the track vehicle impacts an end of the closed-end sleeve such that the sliding device shifts forwards and separates from the outlet end, thus the track vehicle slides down along the cable and passes through the inlet end and then reaches the support base.

Preferably, the opening of the inlet end is provided with a radially extending conical flange, the radially extending conical flange being funnel-shaped and connects to the opening annularly.

Further, the support base is provided with a terminal sleeve being pivotally connected thereon, and the terminal sleeve is of a hollow tubular shape for accommodating at least a part of the sliding device.

In an embodiment, the sliding device being configured in form of a glider-like device, the sliding device includes the closed-end sleeve, a kite being fixed above the closed-end sleeve and a frame for supporting the kite.

Preferably, the outer surface of an upper portion of the closed-end sleeve being provided with a channel allowing the cable to run therethrough such that the closed-end sleeve is suspended on the cable and is capable of sliding up or down along the cable.

In an embodiment, the track section being detachably fixed by a fixing device, the fixing device includes a G-shape fixing clamp and a plurality of C-shape hooks disposed on the G-shape fixing clamp and can freely pivot relative to the G-shape fixing clamp. The G-shape fixing clamp includes a plurality of bend portions and two generally opposite planes. The two planes are tightly attached to the surface of a plate-like object when the G-shape fixing clip is fixed to the plate-like object. The C-shape hook is configured to adapt to the central outer portion of the connector device, so that the connector device is detachably fixed on the C-shape hook. The C-shape hook is further provided with a lock catch which is used for fastening the connector device which is fixed on the C-shape hook.

Preferably, a friction reinforced surface is provided on each of the two generally opposite planes.

The present invention further provides a track vehicle suitable for operation in the toy track system, which includes a vehicle body having opposite first and second ends, at least two diverting pulleys which are respectively arranged on both sides of the vehicle body, at least one drive wheel mechanically connected to a motor in the vehicle body is disposed at the second end, a control unit connected to the motor and battery, at least two traveling pulleys are respectively disposed on two sides of the first end, the at least two driving pulleys and the at least one drive wheel are configured so that the track vehicle stands steadily and runs on a flat surface other than the toy track system, and a biasing wheel is provided on top of the track vehicle for producing a biasing force against the inner wall of the pipe track sections that is in contact with the drive wheel to keep the drive wheel frictionally connected with the inner wall of the pipe track for driving the track vehicle along the pipe track sections.

Preferably, the biasing wheel is located in a position directly opposite the drive wheel.

Preferably, the at least two diverting pulleys are disposed at a position closer to the second end or at a position between the at least two traveling pulleys and the at least one drive wheel.

Preferably, the at least one drive wheel is a single drive wheel. Alternatively, the at least one drive wheel is a pair of drive wheels.

Preferably, an axis of the diverting pulley is arranged perpendicular to an axis of the at least two traveling pulleys or of the at least one drive wheel. Wherein, the biasing wheel biases through a spring biased arm.

Preferably, the track vehicle further includes at least one auxiliary biasing wheel pivotally mounted on the arm and closer to the first end than the pressure wheel, and both the biasing wheel and the auxiliary pressure wheel is able to displace radially.

Preferably, the track vehicle further includes at least two guide members, the guide members are at least two protrusions provided on the top of the track vehicle, and the guide members have a smooth and rounded surface in order to slide along the inner surface of the pipe track sections. The track vehicle being suitable for traveling in the aforementioned toy track system.

The present invention further provides a method of operation for a track vehicle to travel in the toy track system, including the steps of: a) providing a track vehicle according to any one of claims 16 to 24, b) driving the track vehicle to the track section from the inlet end, c) driving the track vehicle to the outlet end and entering the sliding device and sliding down the cable, when the sliding device passes the inlet end, d) reversing the track vehicle such that the track vehicle drops into the guiding device of the inlet end, and repeating steps the above steps b) to step d).

BRIEF DESCRIPTION OF THE DRAWINGS

The present invention will now be specifically described by way of example only with reference to the accompanying drawings, in which.

DETAILED DESCRIPTION OF EMBODIMENTS

The following clearly and completely describes the technical solutions in the embodiments of the present invention with reference to the accompanying drawings in the embodiments of the present invention. Apparently, the described embodiments are merely some but not all of the embodiments of the present invention. All other embodiments based on the embodiments of the present invention and obtained by a person of ordinary skill in the art without creative efforts shall fall within the protection scope of the present invention.

Figure 1:
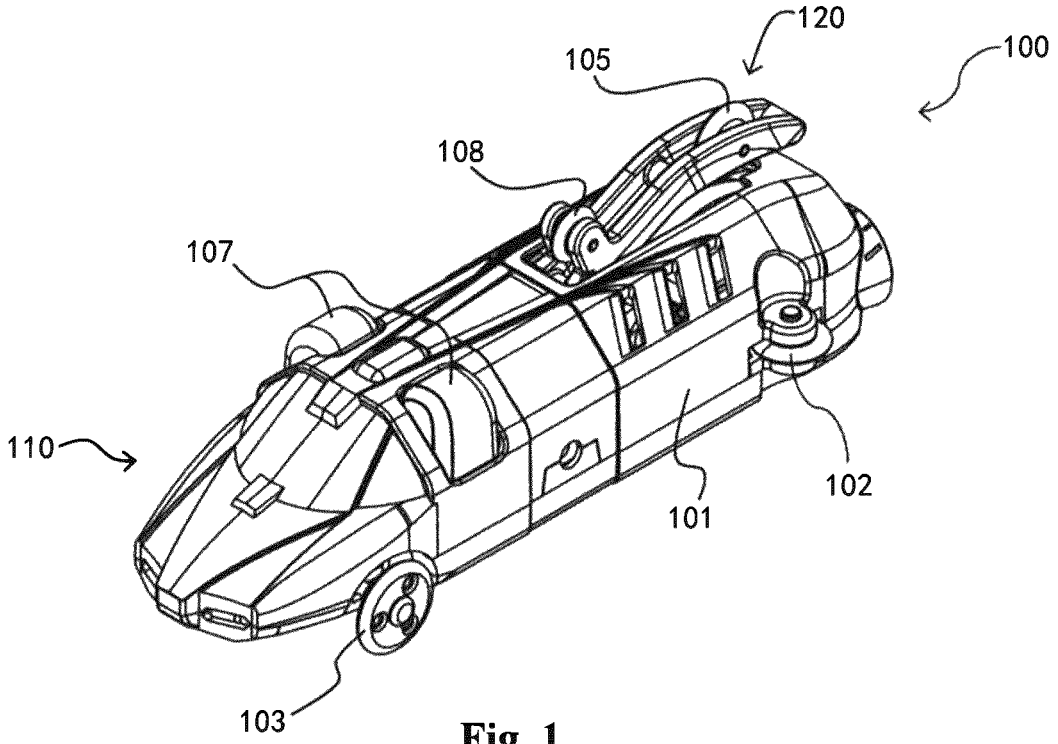
FIG. 1 is a perspective view of a first embodiment of a toy track vehicle according to the present invention.
Figure 2:
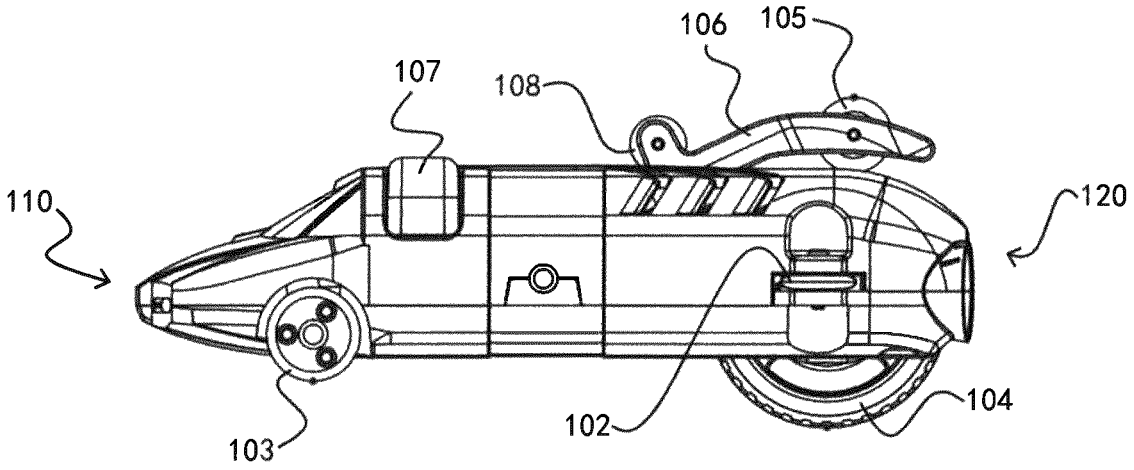
FIG. 2 is a side view of a first embodiment of a toy track vehicle according to the present invention.

Referring to FIG. 1 to FIG. 2 of the drawings, an embodiment of the present invention provides a track vehicle 100 that generally includes a vehicle body 101 having opposite first and second ends, a plurality of diverting pulleys 102 and at least two traveling pulleys 103, at least one drive wheel 104 mechanically connected to an in-vehicle motor, and a control unit connected to the motor and battery (not shown in the drawings). The control unit can be remotely connected to a remote control device in the player's hand to wirelessly control the speed and direction of the track vehicle. The track vehicle 100 can be divided into an exterior portion and a bottom portion. The bottom portion is a generally smooth surface. The exterior portion can be configured to imitate the style of a real car so as to increase the sense of reality.

Figure 3:
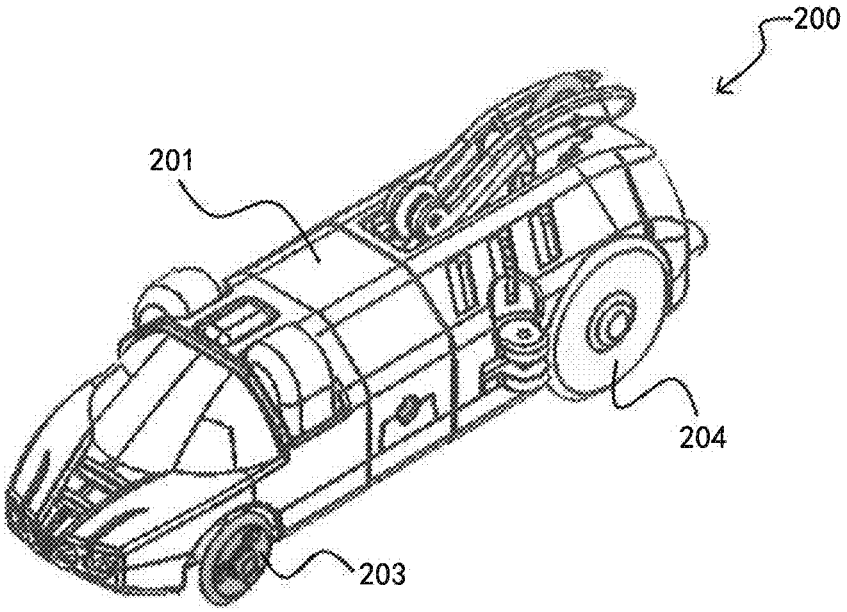
FIG. 3 is a perspective view of a second embodiment of a toy track vehicle according to the present invention.
Figure 4:
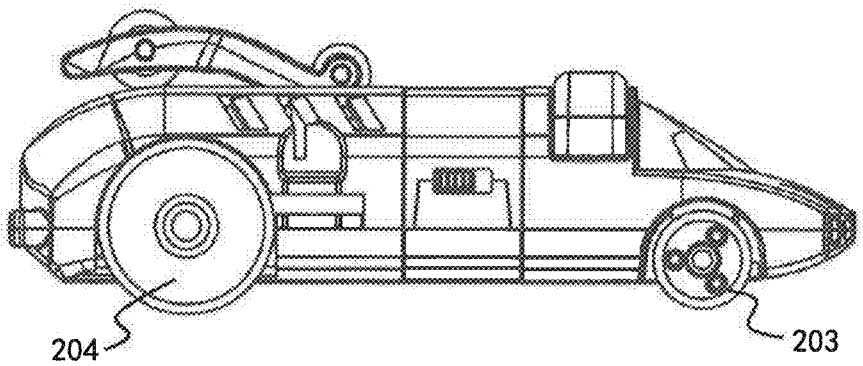
FIG. 4 is a side view of a second embodiment of a toy track vehicle according to the present invention.

The track vehicle includes a vehicle body 101 having opposite first and second ends. The first end and the second end are respectively the front end 110 and the rear end 120. According to the present embodiment, the drive wheel 104 is disposed at a central position of the rear end 120, and the two driving pulleys 103 are respectively disposed at positions on both sides of the front end 110 that are closer to the vehicle bottom portion. Alternatively, according to another embodiment and FIGS. 3 and 4, the drive wheel 204 may be disposed on both sides of the rear end 220 to resemble the arrangement of four wheels of a real car. In addition, the track vehicles of the above two embodiments can stand balanced being stationary and run steadily on a smooth surface.

Preferably, the diverting pulleys 102 are respectively disposed on two sides of the vehicle body 101 are pivotally mounted on both sides of the vehicle body 101. According to the present embodiment, the diverting pulleys 102 are disposed at a position closer to the rear end 120. This arrangement provides lateral support for the rear end 120 to prevent or reduce body roll of the vehicle body 101 and maintains the vehicle body 101 in an upright or substantially upright position while the track vehicle 100 is traveling in a track or a pipe track. The above is particularly advantageous for configuration having a single drive wheel 104. In addition, the diverting pulley 102 also has a function of assisting the steering of the track vehicle which enables the same to smoothly pass through curved track sections while maintaining its speed. Alternatively, the diverting pulley 102 may be also disposed at a position closer to the front end 110. According to another embodiment, the diverting pulley 102 is arranged at a position between the two driving pulleys 103 and the drive wheel 104. According to the above embodiments, the axis of the diverting pulley 102 is set perpendicular to the axis of the driving pulley or the drive wheel 104. However, other similar arrangements, for example, where the above axes form a 45 degree angle there between, may also have the same effect. Alternatively, rounded protrusions may be provided at corresponding positions on both sides of the vehicle body 101 replacing the pivotable diverting pulleys 102 as mentioned.

The at least one drive wheel 104 is mechanically connected to a motor provided in the vehicle body 101 through gears. Alternatively, the at least one drive wheel 104 may be directly connected to the motor via a rotating shaft. According to another embodiment shown in FIGS. 3 and 4, the driving force of the track vehicle 200 is provided by a pair of the drive wheels 204 disposed at the rear end. Accordingly, the two types of track vehicles 100 and 200 both have the characteristics of rear-wheel-drive vehicles such that the track vehicles can run and climb at high speeds in the track, especially in the pipe track sections. Such track vehicles will exhibit an over-steering effect where the rear end slides outwards during reversing and thus making it more fun to drive.

According to FIGS. 1 to 2, the track vehicle 100 is further provided with a biasing wheel 105 disposed on the top of the vehicle body 101. The biasing wheel 105 is used for exerting a bias force on one side of the inner wall of the pipe track to keep the drive wheel 104 of the track vehicle 100 in contact with the opposite side of the inner wall so that a certain amount of friction force is maintained between the drive wheel 104 and the inner wall of the pipe track section for the track vehicle 100 to accelerate, decelerate or stop. Preferably, the biasing wheel 105 is located at a position directly opposite the drive wheels 104 so as to apply the biasing force to the drive wheel 104.

In a preferred embodiment, the biasing wheel 104 is biased outwardly by a spring biased arm 106. The biasing wheel 105 is pivotally disposed on the free end of the arm 106 facing the rear end. The other end of the arm 106 is pivotally connected to the top of the vehicle body 101, and the arm 106 is biased upwards by a spring.

In addition, the track vehicle 100 also has at least two guide members 107. Each guide member 107 is a protrusion provided on the top of the track vehicle and has a smooth and rounded surface in order to slide along the inner wall of the pipe track sections. The guide members 107 assist the track vehicle 100 maintaining the position of the front end at the approximate centre of the pipe track sections in response to changes in level and directions, and at the same time, keeping the driving pulley 103 as close as possible to the wall of the pipe track sections, and ensuring that the track vehicle 100 runs smoothly and at high speed in the pipe track smoothly while preventing the track vehicle 100 from being caught in the curved pipe track sections. In a preferred embodiment, the track vehicle 100 may be wirelessly controlled so that the player can use a remote control to wirelessly control the track vehicle 100 to drive forward, stop or move backward.

In a preferred embodiment, at least one auxiliary biasing wheel 108 is also provided on the arm 106. The auxiliary biasing wheel 108 is pivotally mounted at a front position of the pressure wheel 105 (i.e., a position closer to the first end 110 than the biasing wheel 105). The auxiliary biasing wheel 108 may effectively assists the track vehicle 100 to enter the pipe track sections more smoothly from the open track section. Both the biasing wheel 105 and the auxiliary biasing wheel 108 may be displaced radially. The biasing wheel 105, the auxiliary biasing wheel 108, and the diverting pulley 102 allow the track vehicle 100 to steer in multiple directions at high speed within the pipe track sections.

In addition, due to the track vehicle 100 having the configuration of the at least two driving pulleys 103 and the at least one drive wheel 104, the track vehicle 100 is capable of running on smooth surfaces such as a desk, floor or even on carpet. Therefore, the track vehicle 100 may travel in a toy track system 10 that includes planes, open track sections or/and pipe track sections at the same time. The following is detailed description on the embodiments of the various components of the above toy track system.

Figure 5:
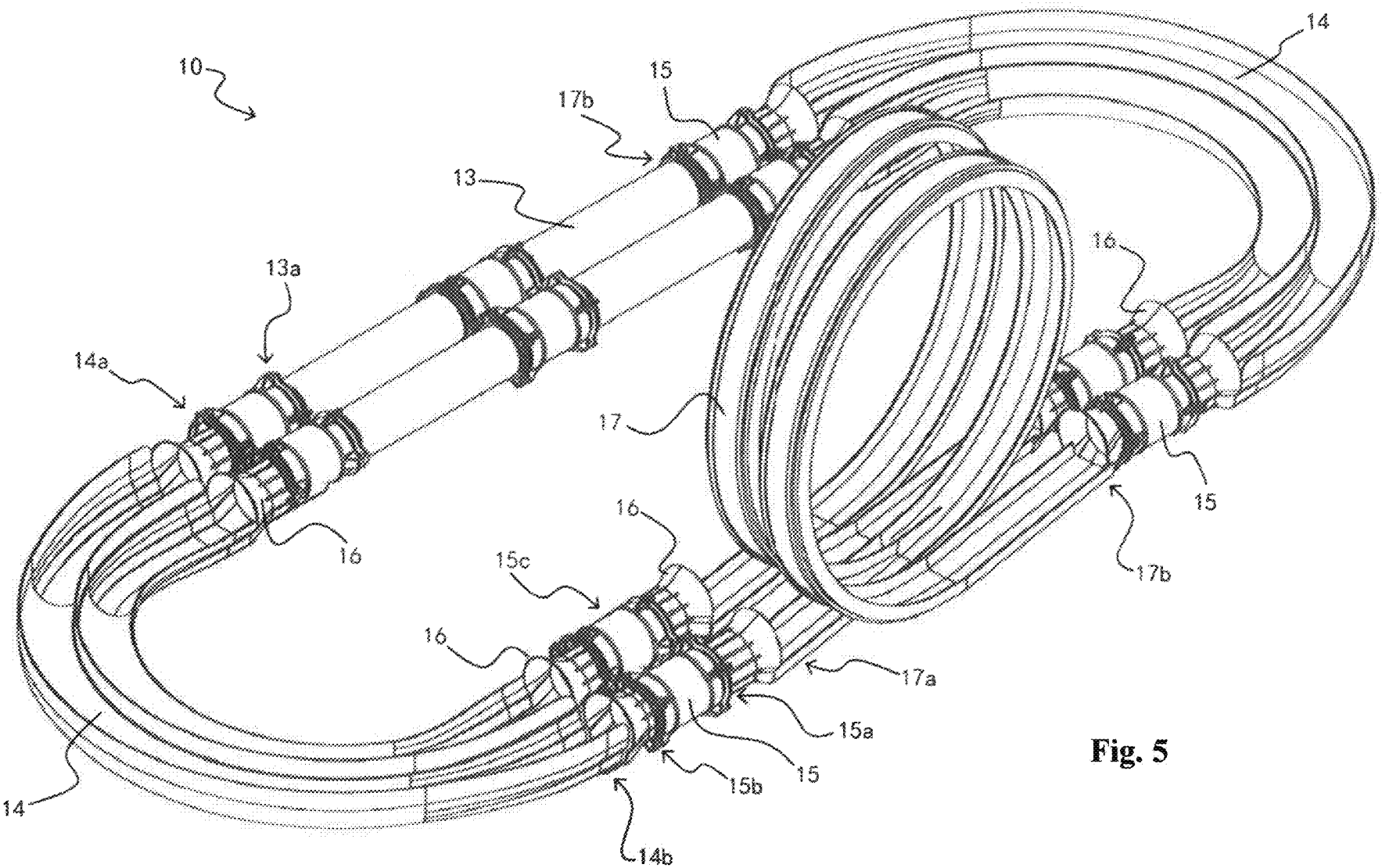
FIG. 5 is a perspective view of a first embodiment of a toy track system according to the present invention.

FIG. 5 first illustrates a toy track system 10 in accordance with an embodiment of the present invention. The toy track system 10 includes an open track portion and a pipe track portion. According to the present embodiment, the toy track system 10 is mainly composed of a pipe track portion including a plurality of straight pipe sections 13, an open track portion including open curved track sections 14, and a plurality of connectors 15 connecting the sections. The open curved track sections 14 are each in the form of a half-pipe thus allowing the player or bystanders to directly view the track vehicle 100 traveling therein. Specifically, the toy track system 10 according to the present embodiment is of a substantially elliptical shape. Basically, two parts of the toy track system 10 are respectively formed by the open curved track sections 14. As illustrated in FIG. 5, the ends 14*a* and 14*b* of the curved track sections 14 are respectively connected to the ends 13*a* of the two straight pipe sections 13 through the connectors 15. The other ends 13*b* of the two straight pipe sections 13 are respectively connected to the two ends 14*a* and 14*b* of the other open curved track sections 14 through the connectors 15 to form the substantially elliptical shape toy track system 10.

The connector 15 is a hollow cylinder having two opposite connecting ends 15*a* and 15*b* for fastening to the ends 13*a* and 13*b* of the straight pipe section 13. The central outer portion 15*c* of the connector 15 has a cylindrical surface, while the outer surface of the connector 15 is provided with two annular flanges 15*d* defining the boundaries of the central outer portion 15*c*. The open curved track section 14 is connected to the connector 15 via a guiding shroud 16. The guiding shroud 16 has a conically outward flange, and is connected to both ends 14*a* and 14*b* of the curved tract section 14, or can be integrally formed together. The smaller end of the guiding shroud 16 is engaged with the ends 15*a* and 15*b* of the connector 15 and can be fastened to the connector 15. The flange of the guiding shroud 16, the biasing wheel 105 and the auxiliary biasing wheel 108 on the track vehicle 100 are configured so as to reduce the bouncing or swaying of the track vehicle 100 caused by the change of height level or direction when the track vehicle 100 passes through the connector 15, and more importantly, preventing the track vehicle 100 from hitting the connector 15 due to misalignment.

According to the above embodiment, the toy track system as described may further include, as part of the open track portion, at least one open track annular track section 17 as shown in FIG. 5. The annular track section 17 is basically a vertically circulating or loop track section and has two connectors 17*a* and 17*b*. The connectors 17*a* and 17*b* connect the ends of the annular track section 17 to respective open curved track sections 14. Likewise, each of the connectors 17*a* and 17*b* has, respectively, the guiding shroud 16 that is connected thereon or integrally formed. The annular track section 17 is connected to the connector 15 via the guiding shroud 16. Further, in order to heighten the excitement, the above-mentioned toy track system 10 can also adopt a double-car racing track, as shown in FIG. 5, which has a double-track section, with two track systems arranged side-by-side for two track vehicles to race each other. Such track system includes two sets of tracks placed side-by-side and may simultaneously have open track sections, pipe track sections and annular or loop track sections so that the track vehicles can shuttle through the open curved track section and the vertical loop track section, and then be guided back to the pipe track sections. The diversity of forms of the tracks greatly enhances the enjoyment of the players and audiences.

Alternatively, the toy track system may be reshaped or infinitely expanded by increasing the mount o of straight pipe section 13, semi-open track section 14, or annular track section 17, thus stimulates the creativity of the player.

Figure 6:
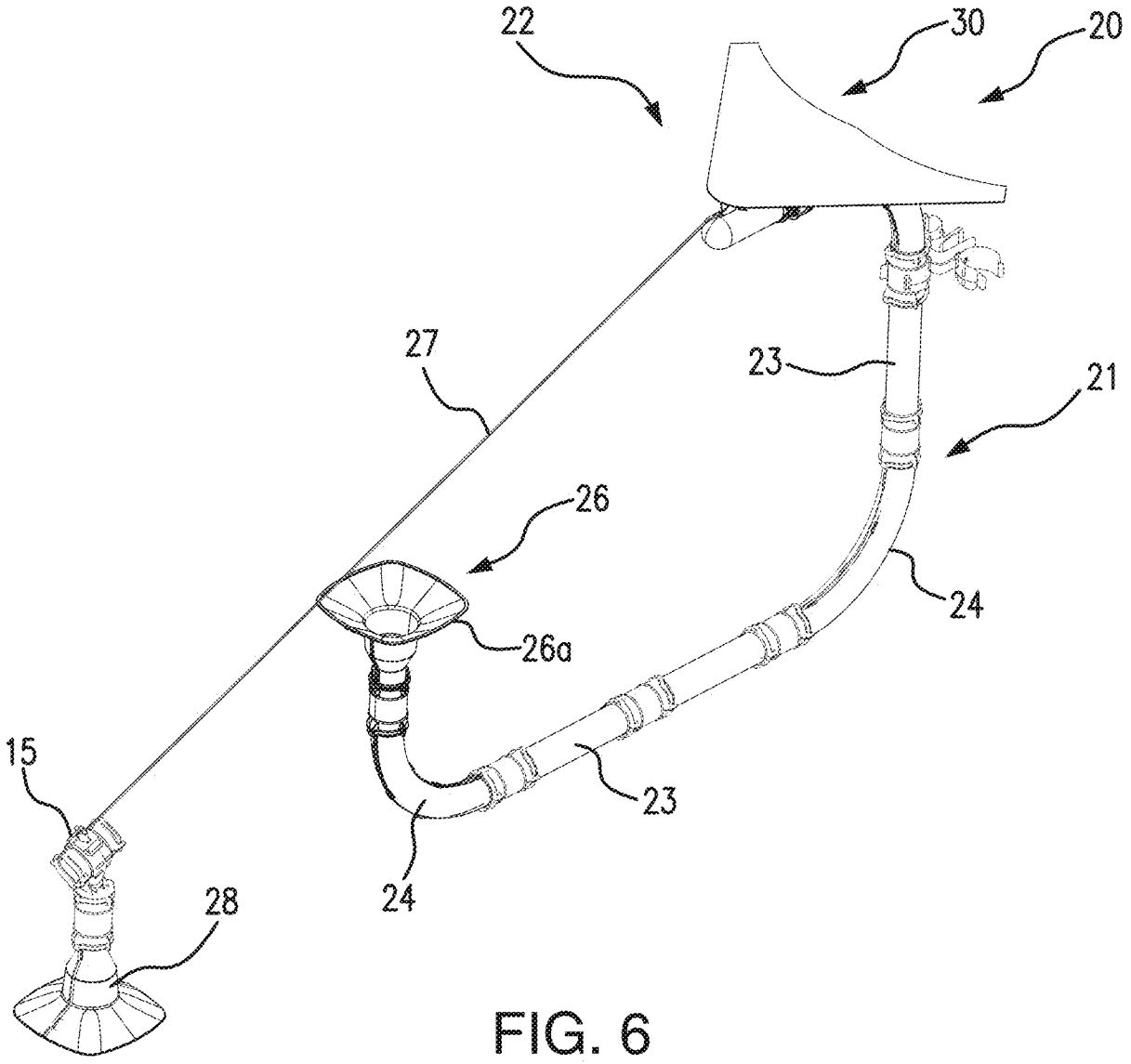
FIG. 6 is a perspective view of a second embodiment of a toy track system according to the present invention.

According to another embodiment of the present invention, the toy track system may be a toy track system 20 which spans upwardly, as shown in FIG. 6. Specifically, the toy track system 20 has a track section 21 including a plurality of pipe track sections, and a non-track section 22 having components other than the plurality of pipe track sections.

The plurality of pipe track section includes a straight pipe section 23 and a curved section 24, The ports of each section are connected to each other by connectors 25 respectively. The curved section 24 may be bent upwards or downwards so that the track vehicle 100 therein climbs vertically or ascends along a straight pipe section 23 connected thereto. Furthermore, the toy track system 20 is configured to allow the track vehicle 100 to temporarily leave the track section 21 and enter the non-track section 22, then slide downwards from an elevated position and finally go back to the pipe track sections of the track section 21 and continue thereon.

Figure 6A:
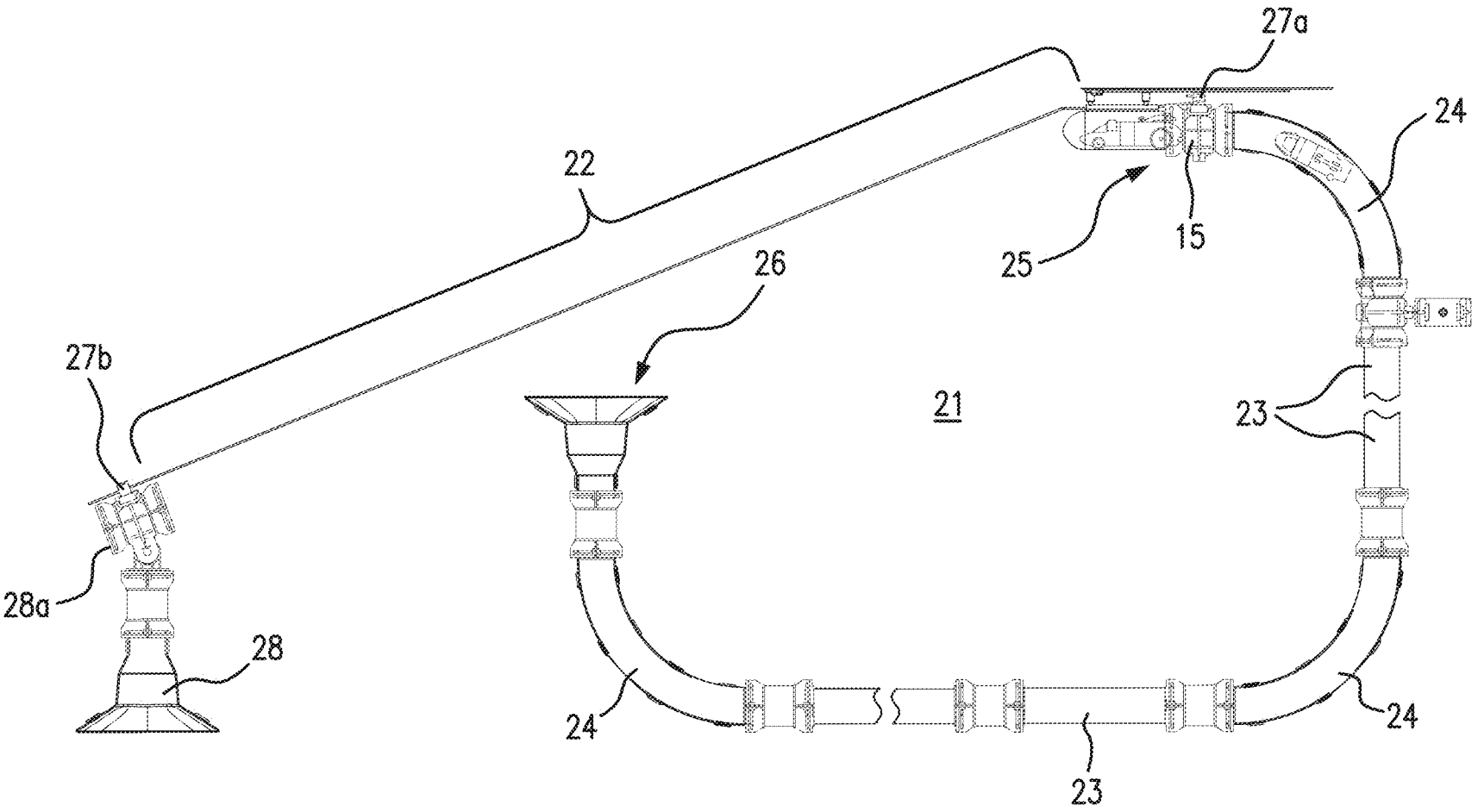
FIGS. 6*a*, 6*b*, and 6*c* show the operating procedures of the toy track system in FIG. 6.

Specifically, according to FIG. 6*a*, the toy track system 20 includes an outlet end 25 disposed at the elevated position and an inlet end 26 correspondingly disposed at a lower position.

The outlet end 25 may be horizontally disposed and the inlet end 26 is vertically upwardly disposed. The outlet end 25 is connected to one end 15*a* of the connector 15, and the connector 15 is configured to be mounted to a bookshelf or any suitable structure so that the outlet end 25 is fixed. The connector 15 of the outlet end 26 is provided with a fastening device for fastening a cable 27. An end 27*a* of the cable 27 is fastened to the connector 15 of the outlet end 25, and the other end 27*b* is connected to a support base 28 placed at the lower position. The support base 28 is also provided with a connector 15 pivotally connected to the top thereof. Similarly, the top of the connector 15 on the support base 28 is also provided with a fastening device for fastening the other end 27*b* of the cable. The connector 15 and the fastening device described above can be applied to the outlet end 25 and the support base 28 via any general suitable fastening means.

Specifically, the cable 27 connecting the outlet end 25 to the support base 28 may be a flexible rope. The player can configure the outlet end 25 to a position elevated from the ground, such as one of the shelves or side panels on a bookshelf. The shelf or side panel may be fitted with a corresponding fixing device to mount the outlet end 25 thereon and is connected to the support base 28 at the lower position via the cable 27. The support base 28 can be stably disposed on any flat surface such as the floor. Preferably, the support base 28 may include additional fixing device for fixing the support base 28 on the surface of the floor. The inlet end 26 may then be positioned at any location along and below the cable 27 and between the outlet end 25 and the support base 28. As shown in FIG. 6*a*, the inlet end 26 is disposed at a position closer to the support base 28 relative to the outlet end 25 so as to form a certain length of travel.

Figure 7A:
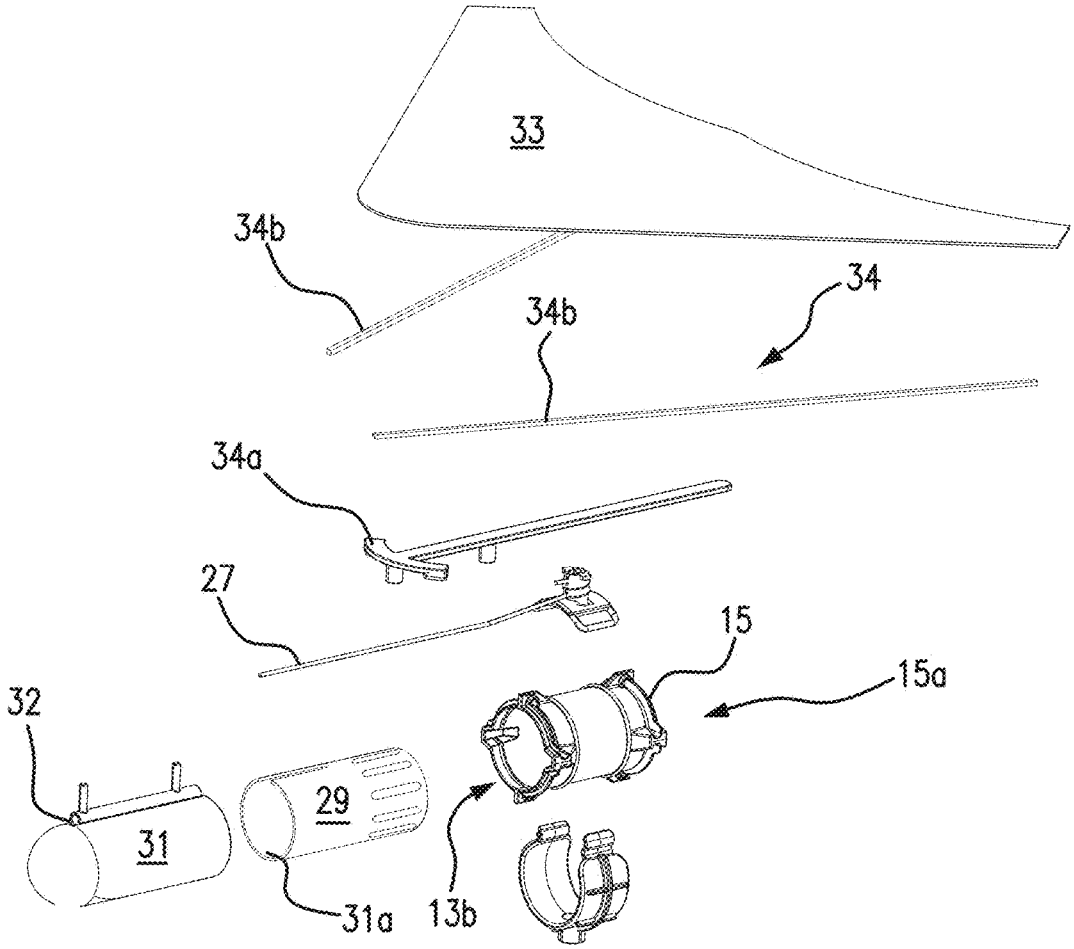
FIG. 7*a* is an exploded view of the sliding device in a second embodiment of the toy track system according to the present invention.
Figure 7B:
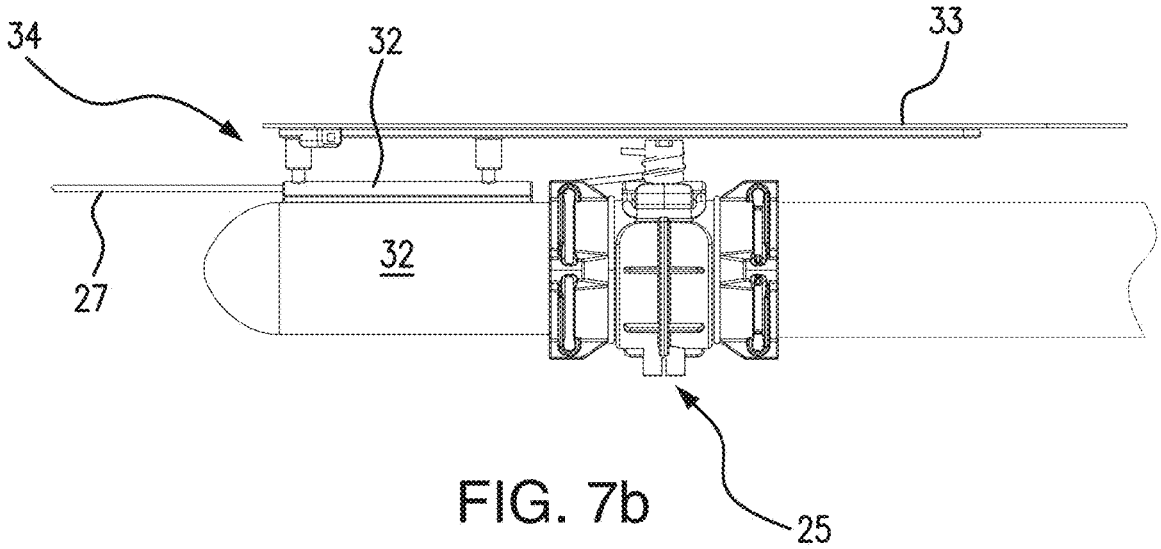
FIG. 7*b* is a side view of the sliding device.

Turning to FIGS. 7*a* and 7*b*, the various components of the outlet end 25 are described herein. The track vehicle 100 runs from the lower position through the curved section 24 to the outlet end 25. A free end of the curved section 24 is connected with one end 15*a* of the connector 15. A fixed sleeve 29, having similar to the inner and outer diameters to that of the curved section 24, is connected to the connector 15. Specifically, one end 29*a* of the fixed sleeve 29 is inserted and fastened into the other end 15*b* of the connector 15 in a similar manner. The other end 29*b* of the fixed sleeve 29 is left about half of the length exposed outside the end 15*b*. Further, a device for fastening the cable, such as a hook or other suitable device, is installed above the connector 15 so that the cable 27 connects the top of the connector 15 on the outlet end 25 to the top of the connector 15 on the support base 28.

Then, the present embodiment provides a sliding device 30 in the form of a glider kite for the track vehicle 100 to slide down the cable 27 using the sliding device 30 from the elevated outlet end 25, thus further diversifies the track varieties in the track system for enhancing excitement. Specifically, the sliding device 30 includes a closed-end sleeve 31. The closed-end sleeve may be transparent to allow a player to view the track vehicle 100 inside. The inner diameter of an opening 31*a* of the closed-end sleeve 31 is slightly larger than the outer diameter of the fixed sleeve 29 to allow a loose fit or a sliding fit to form between the two. The front end of the closed-end sleeve 31 has a dome shape or a flat end shape. The inner space of the closed-end sleeve 31 is sufficient to accommodate the entire track vehicle 100. The closed-end sleeve 31 may be held stationary on the outlet end 25 by the fixed sleeve 29. An outer surface above the closed-end sleeve 31 is provided with a channel 32 for the cable 27 to pass through, so that the closed-end sleeve 31 is suspended on the cable 27 and slide up and down the cable 27. In addition, the glider kite-like sliding device includes a kite 33, which is roughly triangular in shape and made of soft material. A plurality of support rods are used to support the kite. As shown in FIG. 7*a*, the plurality of support rods are a main rod 34*a* and two identical side rods 34*b*. The main rod 34*a* is attached to the central portion of the kite 33, and the two side rods 34*b* are respectively connected to both sides of the kite 33 and are fixedly connected to the front end of the main rod 34*a* to form a substantially arrow shaped bracket 34. Therefore, the entire kite 33 is supported while being stretched open. Alternatively, the kite 33 may also be made of rigid material with the aforementioned support rods omitted, while being able to achieve a similar visual effect. Further, the kite 33 can be fixed to the closed-end sleeve 31 by a general fastening method. As shown in the present figure, the channel 32 is provided with a plurality of protrusions which are respectively matched with corresponding recesses provided on the underside of the main rod 34*a* for the kite 33 to be fixed on the closed-end sleeve 31.

Figure 8:
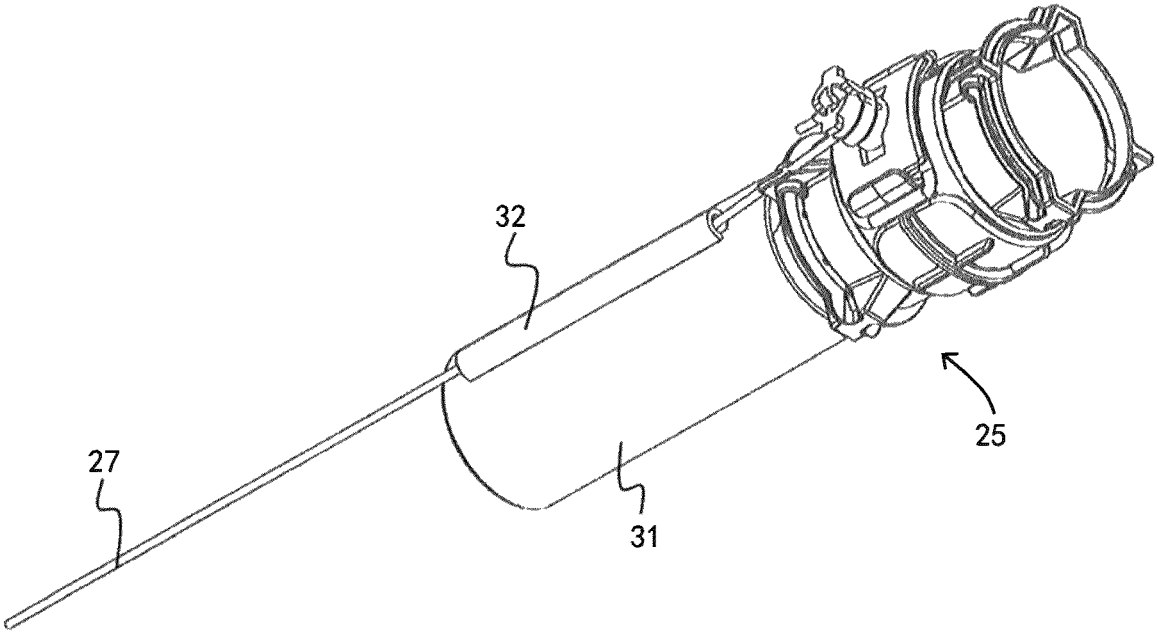
FIG. 8 is a perspective view of the sliding device.
Figure 9:
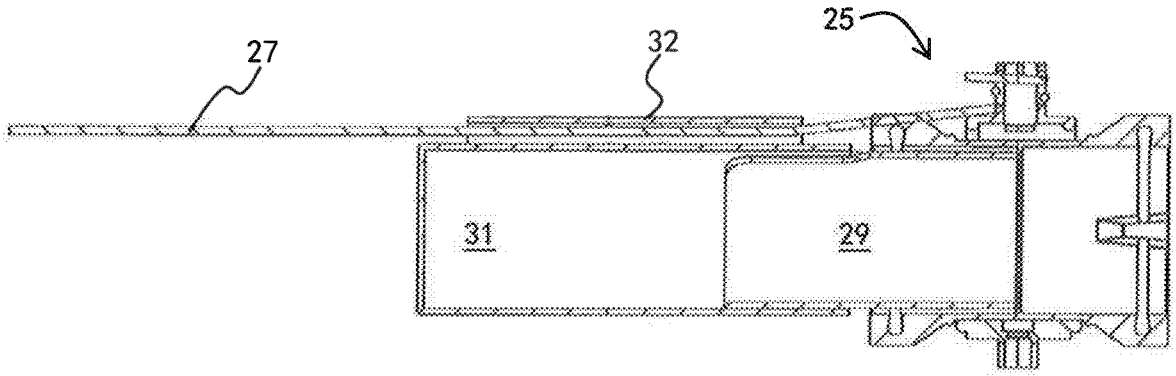
FIG. 9 is a cross-sectional view of the sliding device.

As shown in FIGS. 8 and 9, the sliding device 30 may be held stationary on the outlet end 25 via the sliding fit or loose fit between the fixed sleeve 29 and the closed-end sleeve 31 on the outlet end 25 and be in a ready state. When a forward external force is applied to the closed-end sleeve 29, the sliding device 30 moves forward and disengages the closed-end sleeve 31 from the fixed sleeve 29. As such, when the track vehicle 100 enters the closed-end sleeve 31 of the sliding device 30 and hits the end thereof, the track vehicle 100 moves forward along with the sliding device 30, thereby triggering the sliding device 30 to move away from the outlet end 25 and slide down the cable 27 towards the support base 28, achieving a visual effect of a track vehicle 100 flying down from an elevated position by a glider kite.

Figure 6B:
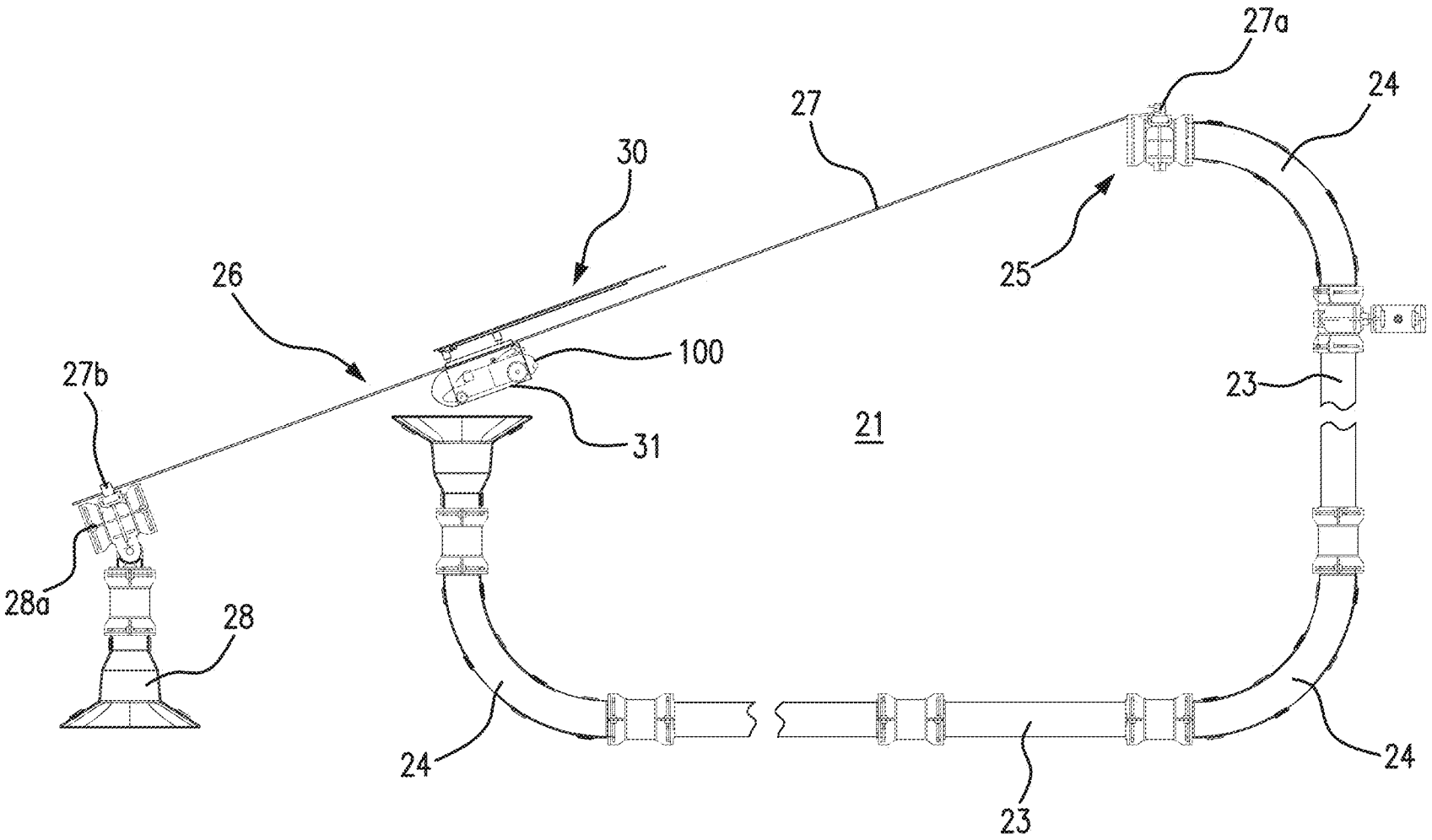
Figure 6C:
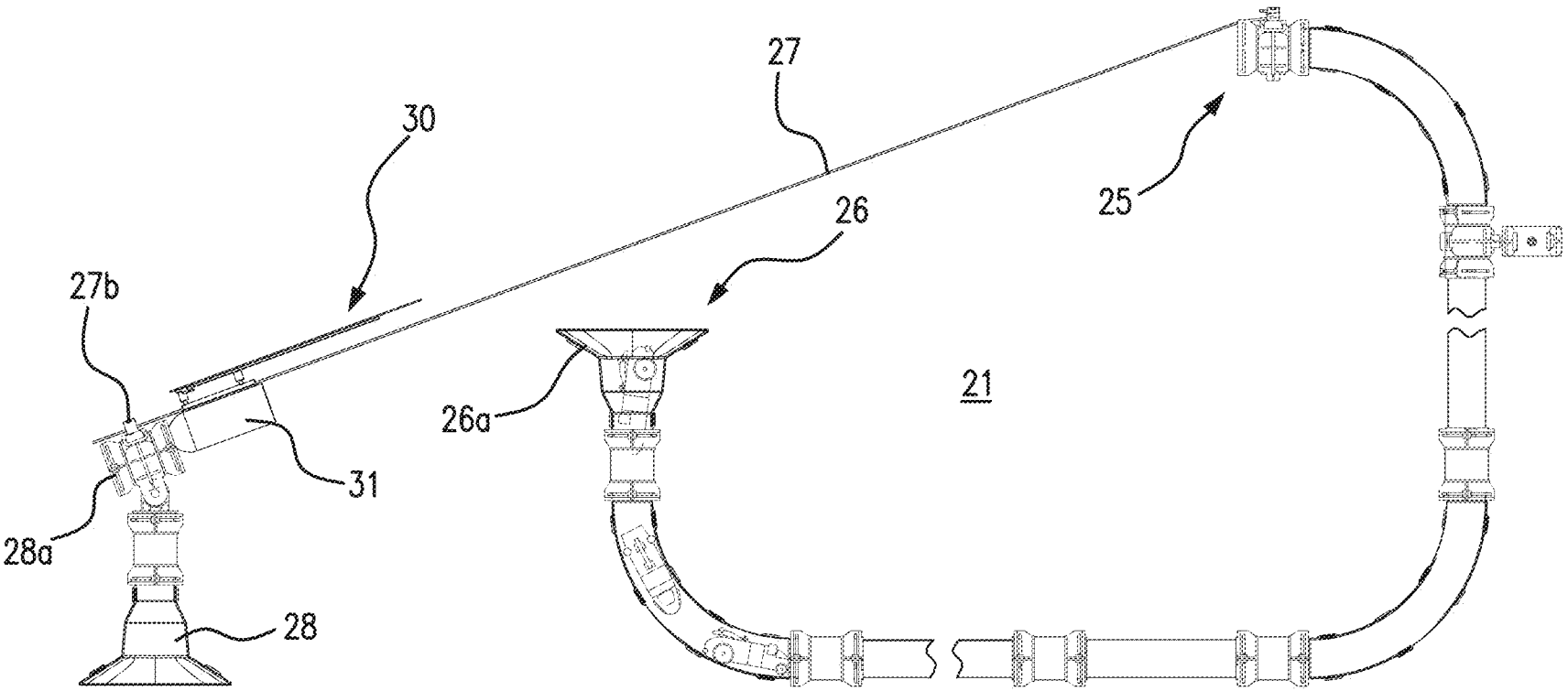

Referring back to FIG. 6*a*, the support base is provided with a terminal sleeve 28*a* pivotally connected thereto. The terminal sleeve 28*a* includes a hollow tubular shape having inner diameter slightly larger than the outer diameter of the closed-end sleeve 29. Preferably, a sliding fit or loose fit is formed between the terminal sleeve 28*a* and the closed-end sleeve 31. The support base 28 is disposed relatively lower than the outlet end 25 and the inlet end 26. Similarly, the terminal sleeve 28*a* on the support base 28 is provided with a device for fastening the flying cable 27. Referring to FIGS. 6*b* and 6*c*, the terminal sleeve 28*a* is configured to pivot relative to the support base 28 so that the terminal sleeve 28*a* may be aligned such that a central axis of the terminal sleeve 28*a* is substantially parallel to the cable 27. As such, the sliding device 30 that slides down the cable 27 naturally aligns with the terminal sleeve 28*a* on the support base 28, facilitating at least part of the closed-end sleeve to insert into the port of the terminal sleeve 28*a* thus stopping the sliding device 30.

Figure 10:
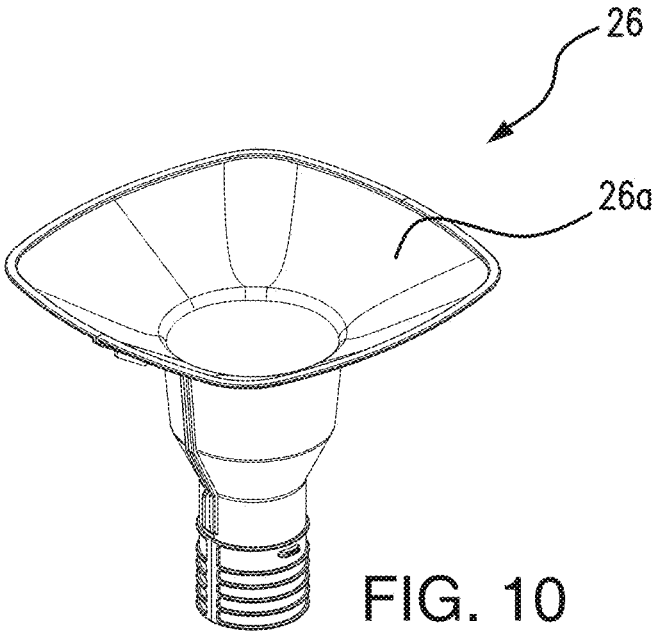
FIG. 10 is a perspective view of a guiding device in a second embodiment of the toy track system according to the present invention.

Further, in order to make the track vehicle 100 returnable to the track section 21, the inlet end 26 is positioned vertically below the cable 27. As shown in FIG. 10, the inlet end 26 has a vertically upward opening in which a radially extending conical flange is provided as a guiding device 26*a*. The guiding device 26*a* is funnel-shaped and connects annularly to the opening of the inlet end 26. The role of the guiding device 26*a* is to provide a larger area for the track vehicle 100 to fall more easily into the inlet end 26 hence reducing the possibility that the track vehicle 100 fall to a position outside the inlet end 26.

During operation of the tot track system, the player remote controls and drives the track vehicle 100 through track section 21 consisting of a series of pipe track sections and the track vehicle reaches the outlet end 25, the track vehicle 100 enters the sliding device 30 and due to the forward impact force, the sliding device 30 displaces forward and disengages from the outlet end 25 and slides down the cable 27. During the descent, the player requires to reverse the track vehicle 100 by controlling via the remote controller, at an appropriate timing such that the track vehicle 100 backs out of the closed-end sleeve 31 and drop on the conical flange 26*a* of the inlet end 26, allowing the track vehicle 100 slides down into the inlet end 26 and continue to travel along the pipe track sections connected thereto until the same reaches the outlet end 25 again. The player may freely change the sliding distance of the sliding device 30 and the height or position of the outlet end 25/inlet end 26 to create tracks of different sizes and difficulties. For example, the outlet end 25 may be set at a height of 10 to 30 feet or more, and the sliding distance may be correspondingly elongated subjecting to the length of the cable 27.

Figure 11:
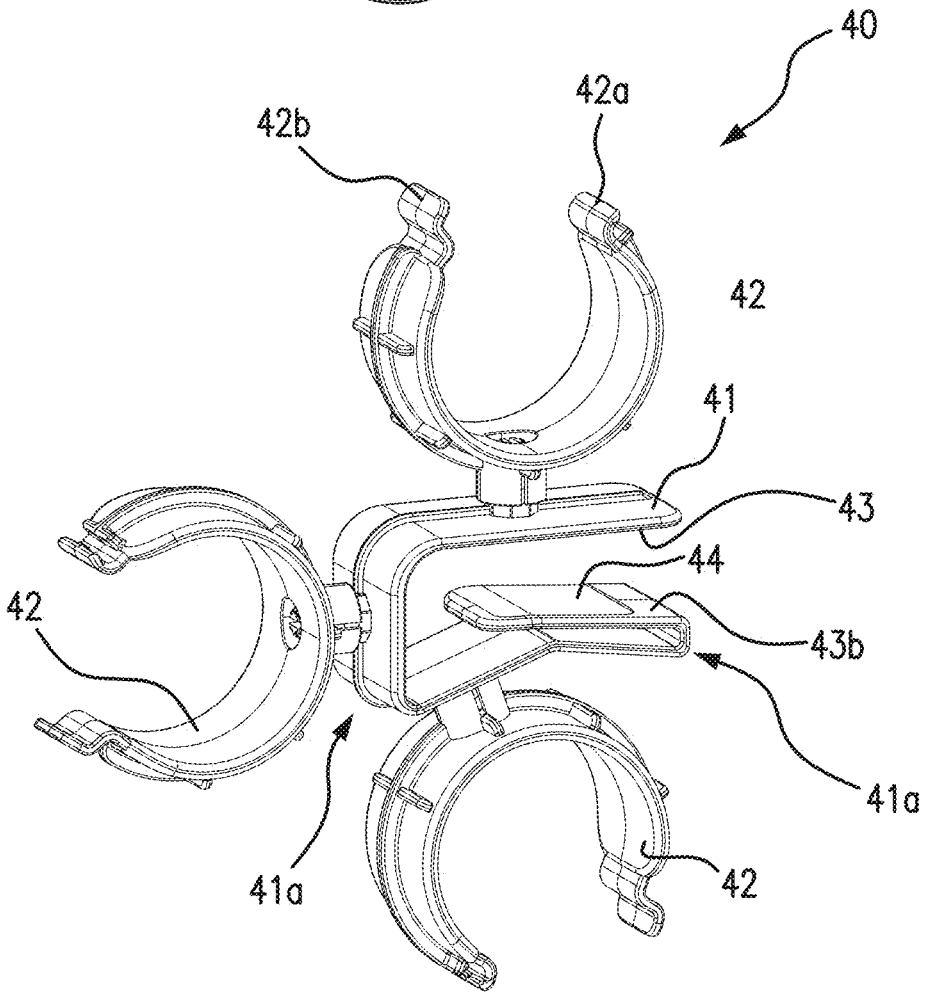
FIG. 11 is a perspective view of a fixing device according to the present invention.
Figure 12:
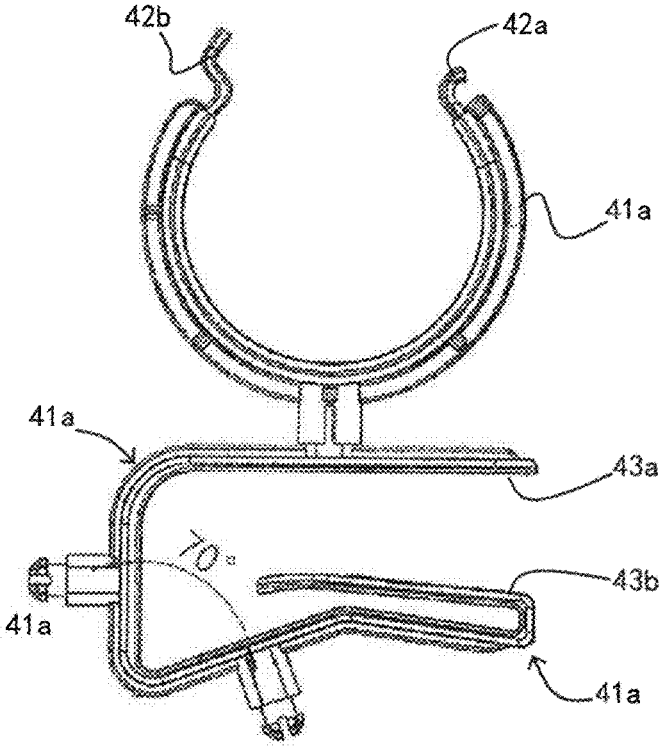
FIG. 12 is a front view of the fixing device according to the present invention.

In order to dispose the outlet end 25 at a relatively higher position than the ground, the outlet end 25 is configured to be detachably fixed by a fixing device 40. The fixing device 40 includes a G-shape fixing clamp 41 and a number of C-shape hooks 42 for fastening to household items, such as bookshelves, wall shelves, or any flat plate. FIGS. 11 and 12 illustrate the structure of the fixing device 40. The G-shape fixing clamp 41 has a plurality of flexing portions 41*a* to provide a certain amount of resiliency so that the G-shape fixing clamp 41 can be fixed to plate-like objects of different thicknesses. In addition, the G-shape fixing clamp also has two substantially opposite planes 43*a* and 43*b*. The G-shape fixing clamp includes the plurality of flexing portions 41*a* such that the planes 43*a* and 43*b* can be maintained in close contact with the surface of the plate-like objects during use. The two substantially opposite planes 43*a* and 43*b* are also provided with a friction reinforced layer 44, such as rubber, to further enhance the stability of the fixing device 40. A plurality of C-shape hook 42 is respectively disposed on the outer surface of the G-shape fixing clamp 41. Preferably, the C-shape hooks 42 are secured to the G-shape fixing clamp 41 by spring hooks and are free to pivot.

Figure 13:
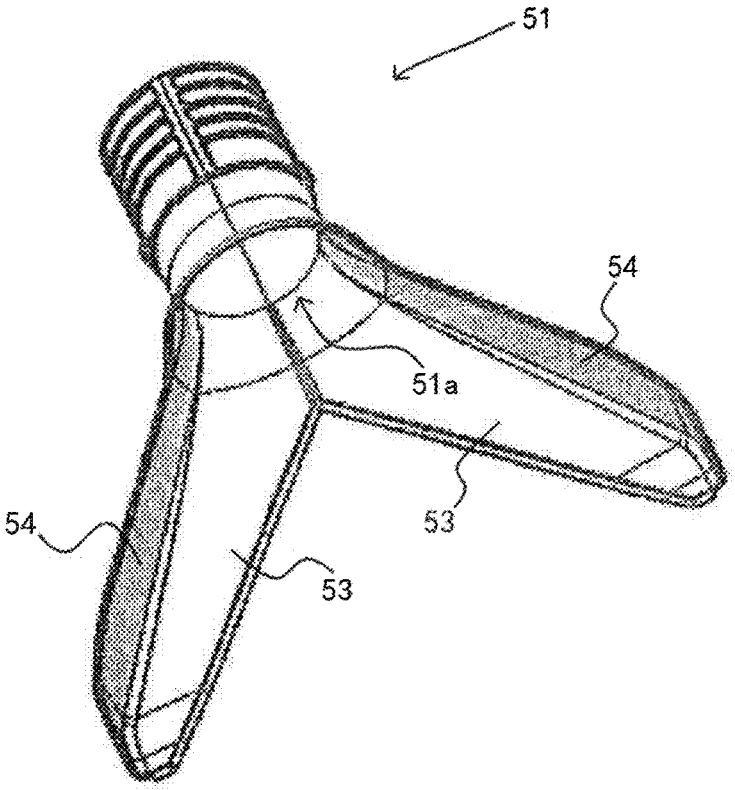
FIG. 13 is a perspective view of a guiding device.
Figure 14:
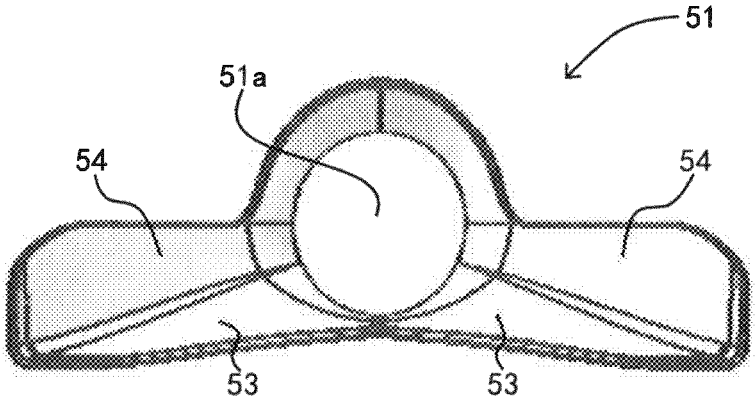
FIG. 14 is a front view of a guiding device.

The C-shape hook 42 is configured such that it adapts to central outer portion 15*c* of the connector 15, so that the connector 15 is detachably fixed on the C-shape hook 42. As the central outer portion 15*c* of the connector 15 is cylindrical, the connector 15 can be fixed on the C-shape hook 42 at different rotational positions. Further, one end of the C-shape hook 42 is provided with a rear end hook 42*a* while and the other end is provided with a locking hook 42*b*. The rear end hook 42*a* matches with the rear end opening 45*a* of the lock catch 45 to form a hinge. The locking hook 42*b* passes through the lock opening 45*b* at the front end of the lock catch 45 to lock the lock catch 45 of the C-shape hook 42. Once locked, the lock catch 45 is configured to apply pressure to the C-shape hook 42 and thus fastens the connector 15 therein. Similarly, the method for fixing the C-shape hook 42 described above may also be used for fixing the connector 15 (i.e., the terminal sleeve 28*a*) on the outlet end 25 and the support base 28. With the fixing device 40, the player is free to set the sections of the track at different locations within home rather than being confined to a flat and open space which allows the player more space for inspiring creatively. In addition, the present invention provides another component for the track vehicle 100 to temporarily leave the track section 21. Referring to FIGS. 13 and 14, the toy track system may be provided with at least two guiding devices 51 that allow the track vehicle 100 to enter and exit a flat surface plane from the pipe track section. The two guiding devices 51 are configured to be used with the aforementioned pipe track sections and may be respectively mounted to an outlet end and an inlet end of interconnected hollow pipe track sections which are placed on a flat surface. The guiding device 51 is of fan-shape and has a guide port 51*b* wider than a pipe opening 51*a*. The guide port 51*b* lies flush against the flat surface when being placed thereon. The guide device 51 has a ramp 53 connecting the pipe opening 51*a* to the flat surface. Guiding flanges 54 are respectively disposed on both sides of the ramp 53 to guide the track vehicle 100 into the pipe opening 51*b* and prevent the track vehicle 100 from being misaligned. The ramp 53, the pipe opening 51*b*, and the flat surface form a substantially flat transition so that the track vehicle 100 is able to travel smoothly and maintain speed when entering or exiting the guiding devices 51. With the use of the guiding devices 51, the track vehicle 100 is free to enter and exit the pipe track sections and is able to travel on flat surfaces such as the ground or a table. Subsequently, the track vehicle 100 can be guided back to the track section via the guiding device 51, thus further adding different variations of tracks to the toy track system.

For those skilled in the art, the present invention is not limited to the detail of the above exemplary embodiments, and the present invention can be implemented in other specific forms without departing from the spirit or basic features of the present invention. Therefore, the above embodiments should be considered as exemplary and non-limiting.

In addition, it should be understood that although the present specification is described in terms of embodiments, not every embodiment includes only a single technical solution. This description of the specification is merely for the sake of clarity, and those skilled in the art should consider the specification as a whole. The technical solutions in the embodiments can also be combined as appropriate to form other embodiments that can be understood by those skilled in the art. However, the protection scope of the present invention is defined by the appended claims rather than the foregoing description, and it is therefore intended that all changes that come within the meaning and range of equivalents of the claims are embraced by the present invention, and any reference signs in the claims should not be regarded as limiting the involved claims.

The invention claimed is:

1. A toy track system for a track vehicle moving within the track system, wherein the toy track system comprises:

a track section comprising a plurality of pipe track sections connected together to allow the track vehicle to pass through the plurality of pipe sections, wherein the track section includes an inlet end having a pipe opening for the track vehicle to enter the track section, and an outlet end for the track vehicle to exit from the track section, wherein the outlet end is positioned a first distance from a flat surface; and a plurality of connecting devices, wherein each connecting device has two connecting ports for detachably connecting together adjacent pairs of the pipe track sections of the track section;

a non-track section not including any pipe track sections and along which the track vehicle may pass from the outlet end to the inlet end of the track section, wherein the non-track section comprises a support base positioned a second distance from the flat surface, wherein the second distance is shorter than the first distance, a cable connected to the outlet end and the support base, and a sliding device sleeved on the cable and for sliding along the cable, wherein the inlet end points vertically upward and is positioned below the cable, the inlet end is located between the outlet end and the support base, and the sliding device conveys the track vehicle from the outlet end to the inlet end; and a guiding device located at the inlet end for guiding the track vehicle to enter the pipe opening of the inlet end from the non-track section, wherein the guiding device comprises an end opening that is larger than the pipe opening.

2. The toy track system according to claim 1, wherein the sliding device comprises a closed-end sleeve having an interior space, and a static sleeve located at the outlet end, the interior space of the closed-end sleeve is sufficient to accommodate the track vehicle, and the closed-end sleeve has a sliding fit with the static sleeve and may be held stationary at the outlet end by the static sleeve.

3. The toy track system according to claim 2, wherein the static sleeve is held stationary at the outlet end, and, when the track vehicle reaches the outlet end, the track vehicle enters the interior space of the closed-end sleeve, impacts the closed-end sleeve, and moves and separates the closed-end sleeve from the outlet end, and the closed-end sleeve slides along the cable, passes by the inlet end, and reaches the support base.

4. The toy track system according to claim 3, wherein the pipe opening at the inlet end includes a radially extending conical flange, and the radially extending conical flange has a funnel shape and connects to the pipe opening annularly.

5. The toy track system according to claim 1, wherein the support base includes a terminal sleeve that is pivotally connected to the support base, and the terminal sleeve has a hollow tubular shape for accommodating at least a part of the sliding device.

6. The toy track system according to claim 1, wherein the sliding device is a glider device, and the sliding device comprises a closed-end sleeve, a kite mounted on the closed-end sleeve, and a frame for supporting the kite.

7. The toy track system according to claim 6, including an outer surface, located above the closed-end sleeve and including a channel for passage of the cable, wherein the closed-end sleeve is hung on the cable and is slideable along the cable.

8. The toy track system according to claim 1 including a fixing device for detachably fixing one of the connecting devices to a plate-shaped object, wherein the fixing device comprises:

a G-shape fixing clamp; and a C-shape hook arranged on the G-shape fixing clamp, and pivoting relative to the G-shape fixing clamp, wherein the G-shape fixing clamp comprises a plurality of bent sections and two substantially opposite planar sections for abutting surfaces of the plate-shaped object when the G-shape fixing clamp receives the plate-shaped object, the C-shape hook is configured to adapt to a central outer portion of the connecting device, so that the connecting device may be detachably fixed on the C-shape hook, and the C-shape hook includes a lock catch for fastening the C-shaped hook to the connecting device.

9. The toy track system according to claim 8, including a friction layer on each of the two substantially opposite planar sections.

10. The toy track system according to claim 1, further comprising a track vehicle, wherein the track vehicle comprises:

a vehicle body having opposite first and second ends, two opposed sides, and a top and a bottom;

at least two diverting pulleys respectively arranged on the two opposed sides of the vehicle body;

a motor located in the vehicle body;

at least one drive wheel mechanically connected to the motor and disposed at the second end;

a battery;

a control unit connected to the motor and to the battery;

at least two driving pulleys respectively disposed on the two opposed sides at the first end, wherein the at least two driving pulleys and the at least one drive wheel are configured so that the track vehicle stands and runs on a plane; and a biasing wheel disposed on the top of the track vehicle, wherein the biasing wheel is configured for applying biasing force to an inner wall of a pipe track section that is in contact with the drive wheel of the track vehicle to maintain the drive wheel in frictional contact with the inner wall for driving the track vehicle along the pipe track section.

11. The toy track system according to claim 10, wherein the biasing wheel is located in a position on the track vehicle directly opposite the drive wheel.

12. The toy track system according to claim 10, wherein the at least two diverting pulleys of the track vehicle are disposed at a position closer to the second end or at a position between the at least two driving pulleys and the at least one drive wheel.

13. The toy track system according to claim 10, wherein the at least one drive wheel of the track vehicle is a single drive wheel.

14. The toy track system according to claim 10, wherein the at least one drive wheel of the track vehicle is a pair of drive wheels.

15. The toy track system according to claim 10, wherein the at least two diverting pulleys of the track vehicle, the at least two driving pulleys of the track vehicle, and the at least one drive wheel of the track vehicle have respective axes, and the axis of the at least two diverting pulleys is perpendicular to the axis of the at least two driving pulleys or to the axis of the at least one drive wheel.

16. The toy track system according to claim 10, wherein the track vehicle includes a spring biased aim, and the biasing wheel is biased by the spring biased aim.

17. The toy track system according to claim 16, wherein the track vehicle further comprises at least one auxiliary biasing wheel pivotally mounted on the spring biased aim closer to a first end of the spring biased aim than is the biasing wheel, and both the biasing wheel and the auxiliary biasing wheel are radially displaceable.

18. The toy track system according to claim 10, wherein the track vehicle further comprises at least two guide members, the guide members include at least two protrusions located on the top of the track vehicle, and the guide members have a smooth and rounded surface for slideably moving along the inner wall of the pipe track section.

19. A toy track system for a track vehicle moving within the track system, wherein the toy track system comprises:

a pipe track portion comprising at least one pipe track section for passage of the track vehicle through the pipe track portion, wherein the pipe track portion includes an inlet end having a pipe opening for the track vehicle to enter the pipe track portion, and an outlet end for the track vehicle to exit from the pipe track portion;

an open track portion connected to the pipe track portion, wherein the open track portion includes a plurality of open track sections for passage of the track vehicle along the open track sections, and an open vertical loop section having an inlet and an outlet respectively connected to two of the open track sections for passage of the track vehicle between the open track sections via the open vertical loop section; and a plurality of connecting devices, wherein each connecting device has two connection ends for detachably connecting together a pipe track section and an open track section, and for connecting together an open track section and the open vertical loop section, wherein each connecting device for connection to one of the open track sections or to the open vertical loop section includes, at each connection end, a guiding device for guiding the track vehicle to enter the connecting device, and each guiding device comprises a conical flange having a larger end, larger than the pipe opening, and facing outwardly from the connecting device.

20. The toy track system according to claim 19, further comprising a track vehicle, wherein the track vehicle comprises:

a vehicle body having opposite first and second ends, two opposed sides, and a top and a bottom;

at least two diverting pulleys respectively arranged on the two opposed sides of the vehicle body;

a motor located in the vehicle body;

at least one drive wheel mechanically connected to the motor and disposed at the second end;

a battery;

a control unit connected to the motor and to the battery;

at least two driving pulleys respectively disposed on the two opposed sides at the first end, wherein the at least two driving pulleys and the at least one drive wheel are configured so that the track vehicle stands and runs on a plane; and a biasing wheel disposed on the top of the track vehicle, wherein the biasing wheel is configured for applying biasing force to an inner wall of a pipe track section that is in contact with the drive wheel of the track vehicle to maintain the drive wheel in frictional contact with the inner wall for driving the track vehicle along the pipe track section.

21. The toy track system according to claim 20, wherein the biasing wheel is located in a position on the track vehicle directly opposite the drive wheel.

22. The toy track system according to claim 20, wherein the at least two diverting pulleys of the track vehicle are disposed at a position closer to the second end or at a position between the at least two driving pulleys and the at least one drive wheel.

23. The toy track system according to claim 20, wherein the at least two diverting pulleys of the track vehicle, the at least two driving pulleys of the track vehicle, and the at least one drive wheel of the track vehicle have respective axes, and the axis of the at least two diverting pulleys is perpendicular to the axis of the at least two driving pulleys or to the axis of the at least one drive wheel.

24. The toy track system according to claim 20, wherein the track vehicle further comprises at least two guide members, the guide members include at least two protrusions located on the top of the track vehicle, and the guide members have a smooth and rounded surface for slideably moving along the inner surface of the pipe track section.

* * * * *